US007861772B2

(12) United States Patent
Blair

(10) Patent No.: US 7,861,772 B2
(45) Date of Patent: Jan. 4, 2011

(54) PACKER RETRIEVING MILL WITH DEBRIS REMOVAL

(75) Inventor: Steven G. Blair, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/466,668

(22) Filed: May 15, 2009

(65) Prior Publication Data

US 2010/0288485 A1 Nov. 18, 2010

(51) Int. Cl.
*E21B 31/08* (2006.01)
*E21B 34/00* (2006.01)
*E21B 31/00* (2006.01)

(52) U.S. Cl. ..... 166/99; 166/162; 166/316; 166/377; 166/55.6; 166/55.7; 294/86.24; 294/86.1

(58) Field of Classification Search ..... 166/99, 166/162, 316, 55.7, 377, 55.6, 55; 294/86.24, 294/86.1
See application file for complete search history.

(56) References Cited

U.S. PATENT DOCUMENTS 3,005,493 A * 10/1961 Crowe et al. ..... 166/55
3,091,290 A * 5/1963 Clark, Jr. ..... 294/86.22
5,123,489 A 6/1992 Davis et al.
6,250,387 B1 6/2001 Carmichael et al.
6,607,031 B2 8/2003 Lynde et al.
6,776,231 B2 8/2004 Allen
7,188,675 B2 3/2007 Reynolds
7,322,408 B2 1/2008 Howlett
2008/0029263 A1 2/2008 Palmer et al.

OTHER PUBLICATIONS

Haughton, D.B., et al., "Reliable and Effective Downhole Cleaning System for Debris and Junk Removal", SPE 101727, Sep. 2006, 1-9.
Connell, P., et al., "Removal of Debris for Deepwater Wellbores Using Vectored Annulus Cleaning System Reduces Problems and Saves Rig Time", SPE 96440, Oct. 2005, 1-6.
Joppe, L.C., et al., Using High-Frequency Downhole Vibration Technology to Enhance Through-Tubing Fishing and Workover Operations, SPE 99415, Apr. 2006, 1-4.

* cited by examiner

*Primary Examiner*—Daniel P Stephenson
*Assistant Examiner*—Yong-Suk Ro
(74) *Attorney, Agent, or Firm*—Steve Rosenblatt

(57) ABSTRACT

A mill is configured to have large debris passages disposed among a series of radially extending blades. The mill center is adapted to accept a retention nut that supports a tool that secures the downhole tool being milled out, such as a packer. Reverse flow takes cuttings into the large open area between the blades to pass up in an annular space around a support for the retention nut. The passage then opens up to a maximum dimension leaving only the tubular wall needed for structural strength to support the mill and conduct cuttings into a debris removal tool.

17 Claims, 5 Drawing Sheets

PACKER RETRIEVING MILL WITH DEBRIS REMOVAL

FIELD OF THE INVENTION

The field of the invention is milling up a downhole tool and more specifically a packer while being able to retrieve it after it is milled loose and configuring the mill to conduct milling debris to debris removal tool through passages configured to minimize clogging.

BACKGROUND OF THE INVENTION

When a metal object, such as a section of casing, a packer, or a lost tool, is to be removed from a well bore, the best method of removal is often to mill the object into small cuttings with a mill such as a pilot mill, a section mill, or a junk mill, and then to remove the cuttings from the well bore. Furthermore, a milling tool will often result in the removal of scale, cement, or formation debris from a hole.

It is important to remove the cuttings, or other debris, because other equipment subsequently used in the well bore may incorporate sealing surfaces or elastomers, which could be damaged by loose metal cuttings being left in the hole. Most commonly, the metal cuttings and other debris created by milling are removed from the well bore by circulating fluid down the inside of the workstring and out openings in the milling tool, then up the annulus to the surface of the well site. This "forward circulation" method usually leaves some cuttings or debris stuck to the side of the well casing or well bore surface, and these cuttings or debris can damage some of the tools which may subsequently be run into the hole. Also, safety devices such as blow-out preventers usually have numerous cavities and crevices in which the cuttings can become stuck, thereby detracting from the performance of the device or possibly even preventing its operation. Removal and clean-out of such safety devices can be extremely expensive, often costing a quarter of a million dollars or more in the case of a deep sea rig. Further, rapid flow of debris-laden fluid through the casing can even damage the casing surface. Nevertheless, in applications where a large amount of metal must be removed, it is usually necessary to mill at a relatively fast rate, such as 15 to 30 feet of casing per hour. These applications call for the generation of relatively large cuttings, and these cuttings must be removed by the aforementioned method of "forward circulation", carrying the metal cuttings up to the well site surface via the annulus.

In some applications, such as preparation for the drilling of multiple lateral well bores from a central well bore, it is only necessary to remove a relatively short length of casing from the central bore, in the range of 5 to 30 feet. In these applications, the milling can be done at a relatively slow rate, generating a somewhat limited amount of relatively small cuttings. In these applications where a relatively small amount of relatively small cuttings are generated, it is possible to consider removal of the cuttings by trapping them within the bottom hole assembly, followed by pulling the bottom hole assembly after completion of the milling operation. The advantage of doing so is that the cuttings are prevented from becoming stuck in the well bore or in a blow-out preventer, so the risk of damage to equipment is avoided.

Some equipment, such as the Baker Oil Tools combination ball type Jet and junk basket, product number 130-97, rely upon reverse circulation to draw large pieces of junk into a downhole junk removal tool. This product has a series of movable fingers which are deflected by the junk brought into the basket, and which then catch the larger pieces of junk. An eductor jet induces flow into the bottom of the junk basket. This tool is typical, in that it is generally designed to catch larger pieces of junk which have been left in the hole. It is not effective at removing small debris, because it will generally allow small debris to pass back out through the basket.

Moreover, the ability of this tool to pick up debris is limited by the fluid flow rate which can be achieved through the workstring, from a pump at the well site. In applications where the tool must first pass through a restricted diameter bore, to subsequently operate in a larger diameter bore, the effectiveness of the tool is severely limited by the available fluid flow rate. Additionally, if circulation is stopped, small debris can settle behind the deflecting fingers, thus preventing them from opening all the way. Further, if this tool were to be run into a hole to remove small cuttings after a milling operation, the small cuttings would have settled to the bottom of the hole, making their removal more difficult. In fact, this tool is provided with coring blades for coring into the bottom of the hole, in order to pick up items which have settled to the bottom of the hole.

Another type of such product is the combination of a Baker Oil Tools jet bushing, product number 130-96, and an internal boot basket, product number 130-21 which uses a jet action to induce fluid flow into the tool laden with small debris. The internal boot basket creates a circuitous path for the fluid, causing the debris to drop out and get caught on internal plates. An internal screen is also provided to further strip debris from the fluid exiting the tool. The exiting fluid is drawn by the jet back into the annulus surrounding the tool. However, here as before, if this tool were to be run into a hole to remove small cuttings after a milling operation, the small cuttings would have settled to the bottom of the hole, making their removal more difficult. Furthermore, here again, the ability of this tool to pick up debris is limited by the fluid flow rate which can be achieved through the workstring.

Another known design is represented by the Baker Oil Tools Model M reverse circulating tool, which employs a packoff cup seal to close off the wellbore between fluid supply exit ports and return fluid exit ports. A reverse circulating flow is created by fluid supply exit ports introducing fluid into the annulus below the packoff cup seal, which causes fluid flow into the bottom of an attached milling or washover tool. This brings fluid laden with debris into the central bore of the reverse circulating tool, to be trapped within the body of the tool. The reverse circulating fluid exits the body of the tool through return fluid exit ports above the packoff cup seal and flows to the surface of the well site via the annulus. This tool relies upon the separation of the supply fluid and the return fluid, by use of the packoff cup seal between the fluid supply exit ports and return fluid exit ports. To avoid damage to this cup during rotation of the tool, the packoff cup seal must be built on a bearing assembly, adding significantly to the cost of the tool. Additionally, here as before, the ability of this tool to pick up debris is limited by the fluid flow rate which can be achieved through the workstring.

Milling downhole components generates debris that needs to be removed from circulating fluid. Fluid circulation systems featuring flow in different directions have been tried. One design involves reverse circulation where the clean fluid comes down a surrounding annulus to a mill and goes through rather large ports in the mill to take the developed cuttings into the mill to a cuttings separator such as the VACS tool sold by Baker Oil Tools. Tools like the VACS cannot be used above a mud motor that drives the mill and can only be used below a mud motor when using a rotary shoe. Apart from these limitations the mill design that requires large debris return passages that are centrally located forces the cutting structure to be mainly at the outer periphery and limits the application of such a system to specific applications.

The more common system involves pumping fluid through a mandrel in the cuttings catcher so that it can go down to the mill and return up the surrounding annular space to a discrete passage in the debris catcher. Usually there is an exterior diverter that directs the debris laden flow into the removal tool. These designs typically had valves of various types to keep the debris in the tool if circulation were stopped. These valves were problem areas because captured debris passing through would at times cling to the valve member either holding it open or closed. The designs incorporated a screen to remove fine cuttings but the screen was placed on the exterior of the tool putting it in harm's way during handling at the surface or while running it into position downhole. These designs focused on making the mandrel the main structural member in the device which resulted in limiting the cross-sectional area and the volume available to catch and store debris. This feature made these devices more prone to fill before the milling was finished. In the prior designs, despite the existence of a screen in the flow stream through the tool, some fines would get through and collect in the surrounding annulus. The fixed debris barriers could get stuck when the tool was being removed. In some designs the solution was to removably mount the debris barrier to the tool housing or to let the debris barrier shift to open a bypass. In the prior designs that used cup seals looking uphole for example, if the screen in the tool plugged as the tool was removed the well could experience a vacuum or swabbing if a bypass around the cup seal were not to open.

Typical of the latter type of designs is U.S. Pat. No. 6,250,387. It accepts debris in FIG. 3 at 11 and all the debris has to clear the ball 12 that acts as a one way valve to retain debris if the circulation is stopped. Debris plugs this valve. The screen 6 is on the tool exterior and is subject to damage in handling at the surface or running it into the well. That screen filters fluid entering at 7 as the tool is removed. It has an emergency bypass 20 if the screen 6 clogs during removal operations. It relies on a large mandrel having a passage 3 which limits the volume available for capturing debris. By design, the cup 5 is always extended.

U.S. Pat. No. 7,188,675 again has a large mandrel passage 305 and takes debris laden fluid in at 301 at the bottom of FIG. 4. It uses internal pivoting valve members 203 shown closed in FIG. 5a and open in FIG. 5b. These valves can foul with debris. It has an exterior screen 303 than can be damaged during handling or running in. Its diverter 330 is fixed.

Finally U.S. Pat. No. 6,776,231 has externally exposed screen material 4 and a debris valve 20 shown in FIG. 3 that can clog with debris. It does show a retractable barrier 9 that requires a support for a part of the tool 7 in the wellbore and setting down weight. However, this barrier when in contact with casing has passages to try to pass debris laden flow and these passages can clog.

Well cleanup tools with barriers that function when movement is in one direction and separate when the tool is moved in the opposite direction are shown in Palmer US Application 2008/0029263. Other articulated barriers are illustrated in U.S. Pat. No. 6,607,031 using set down weight and U.S. Pat. No. 7,322,408 using an inflatable and a pressure actuated shifting sleeve that uncovers a compressed ring to let it expand and become a diverter.

The VACS tool sold by Baker Hughes Incorporated is shown in more detail in FIGS. 1-4 marked as prior art. As shown in FIGS. 1 and 2, a rotating tool 8 according to the present invention has a drive sub 10 at its upper end, a plurality of sections of wash pipe 12, 16, 18 connected to the drive sub 10, a screen crossover 14 and a triple connection sub 20 connected to the wash pipe, and a milling tool 22 connected to the lower end of the triple connection sub 20. The drive sub 10 is adapted to connect to a rotating workstring (not shown) or to a downhole motor (not shown) connected to a non-rotating workstring, such as coiled tubing, by means such as a threaded connection. The sections of wash pipe 12, 16, 18, the screen crossover sub 14, and the triple connection sub 20 serve as a separator housing. The uppermost wash pipe ejection port section 12, which is threaded to the drive sub 10, incorporates a plurality of supply fluid exit or ejection ports 24 penetrating the wall of the wash pipe section 12 at spaced intervals. The screen crossover sub 14, which is threaded to the ejection port section 12, serves to hold a tubular filter screen 32 in place below the ejection ports 24, with the screen 32 extending downwardly toward the milling tool 22 at the lower end of the apparatus. A first wash pipe extension section 16 can be threaded to the screen crossover sub 14, if necessitated by the length of the screen 32. A second wash pipe extension section 18 is threaded to the first extension section 16. The triple connection sub 20 is threaded to the lower end of the second extension section 18.

The milling tool 22 is threaded to the lower end of the triple connection sub 20. A plurality of blades 23 are positioned at intervals about the periphery of the milling tool 22 for milling metal items, such as casing or liner pipe, from the well bore. The lower end of the milling tool 22 can have a drift plate 25, which has a diameter close to the inside diameter of the bore hole in which the milling tool 22 will be used. The drift plate 25 serves to prevent metal cuttings from falling down the bore hole. One or more intake slots or ports 26 are provided in the lower end of the milling tool 22 below the blades 23. In applications where the stuck pipe is not concentrically positioned in the casing or well bore, it has been found that the drift plate 25 can break loose, so in such applications, a milling tool 22 without the drift plate 25 is used, and a single intake port is located at the bottom of the milling tool 22, instead of a plurality of slots 26.

Importantly, a debris deflector tube 28 is threaded into an interior thread in the triple connection sub 20, extending upwardly from the triple connection sub 20 toward the screen 32. A plurality of side ports 30 are provided through the wall of the deflector tube 28. A deflector plate 31 is provided in the upper end of the deflector tube 28 to deflect any metal cuttings or other debris which might be carried by fluid flowing through the deflector tube 28, and to separate the debris from the fluid. Alternatively, other means of separating the debris from the fluid can be used, such as deflection plates within the deflector tube 28 to create a spiral fluid flow, thereby separating the heavy debris from the fluid.

Another important feature of the deflector tube 28 is that its reduced diameter facilitates movement of the cuttings along with the fluid, up to the point of separation of the cuttings from the fluid for deposit in a holding area. In a representative example, the body of the tool might have a nominal diameter of 7⅝ inches, with the deflector tube 28 having a nominal diameter of 2⅜ inches. It has been found that a fluid flow velocity of approximately 120 feet per minute is required to keep the cuttings moving along with the fluid, depending upon the fluid formulation. This flow velocity can be achieved in the exemplary deflector tube 28 with a fluid flow rate of only about ½ barrel per minute. If a reverse circulation tool without the deflector tube 28 were employed, a fluid flow rate of about 6 barrels per minute would be required to keep the cuttings moving. Put another way, if a reverse circulation tool were not used, with forward circulation instead being relied upon to move the cuttings all the way to the surface via the annulus, a fluid flow rate of 4 to 10 barrels per minute, or even more, would be required. This means that use of the tool of the present invention allows the use of smaller pumps and motors at the well site surface, and use of cheaper formulations of fluid.

In the first embodiment of the present invention, as shown in FIG. 1, a plurality of high speed supply fluid eductor nozzles 34 are provided in the wash pipe ejection port section 12, with each eductor nozzle 34 being aligned with one of the ejection ports 24, at a downward angle. As the tool 8 is rotated to mill away the metal item from the well bore with the milling tool 22, fluid is pumped by a pump (not shown) at the surface of the well site down through the workstring (not shown). The fluid flows from the workstring through the drive sub 10, and then through the eductor nozzles 34. Since the eductor nozzles 34 have restricted flow paths, they create a high speed flow of fluid, which is then directed downwardly through the ejection ports 24. As the high speed fluid flows out of the eductor nozzles 34 and through the ejection ports 24, it creates an area of low pressure, or vacuum, in the vicinity of the eductor nozzles 34, within the ejection port section 12 of the separator housing.

This area of low pressure or vacuum in the ejection port section 12 draws fluid up through the intake ports 26 of the milling tool 22, through the deflector tube 28, and through the screen 32. The fluid thusly drawn upwardly then passes out through the ejection ports 24 to the annulus surrounding the separator housing, to flow downwardly toward the milling tool 22. Excess fluid supplied via the workstring can also flow upwardly through the annulus toward the surface of the well site, to return to the pump.

As fluid flows past the milling tool blades 23, it entrains small cuttings or debris generated as the blades mill away the casing or other metal item. This debris-laden fluid then enters the intake ports 26 at the lower end of the milling tool 22 and passes into the interior of the deflector tube 28 within the wash pipe extension section 18. As the debris-laden fluid exits the side ports 30 in the deflector tube 28, the debris, which is heavier than the fluid, tends to separate from the fluid and settle into an annular area 56 between the deflector tube 28 and the wash pipe extension section 18.

The fluid, which may still contain very fine debris, then flows upwardly to contact the inlet side of the screen 32. As the fluid flows through the screen 32, the fine debris is removed by the screen 32, remaining for the most part on the inlet side of the screen 32. Fluid leaving the outlet side of the screen 32 then flows upwardly to the area of low pressure, or vacuum, in the vicinity of the eductor nozzles 34.

In most applications, this eductor nozzle embodiment of the invention will create a sufficient flow velocity to entrain virtually all of the small debris generated by the milling tool 22. In fact, it has been found that a 7⅝ inch tool according to the first embodiment creates a sufficient flushing action to remove the cutting debris from a milling operation within a 30 inch casing. However, in some applications, the flow rate which can be pumped downhole through the workstring may not be sufficient to entrain the milling debris. Such a situation arises when the fluid flow rate which can be created down the sides of the wash pipe is insufficient to entrain the milling debris as the fluid passes the blades 23. In this type of application, it can become necessary to use the second embodiment of the tool of the present invention, which incorporates a downhole motor and pump as the source of pressurized fluid, as illustrated in FIGS. 3 and 4.

The separator apparatus 8' shown in FIGS. 3 and 4 has many elements similar to the apparatus 8 shown in FIGS. 1 and 2. That is, a plurality of ejection ports 24 penetrate the wall of the wash pipe ejection port section 12 at spaced intervals. The screen crossover sub 14 holds a tubular filter screen 32 in place below the ejection ports 24, with the screen 32 extending downwardly toward the milling tool 22 at the lower end of the apparatus. One or more wash pipe extension sections 18 are threaded to the screen crossover sub 14. The triple connection sub 20 is threaded to the lower end of the extension section 18.

The milling tool 22, identical to the milling tool used in the first embodiment, is threaded to the lower end of the triple connection sub 20. A debris deflector tube 28 is threaded into an interior thread in the triple connection sub 20, extending upwardly from the triple connection sub 20 toward the screen 32. Here as before, a plurality of side ports 30 are provided through the wall of the deflector tube 28, and a deflector plate 31 or a series of deflector plates are provided in the deflector tube 28. As FIG. 4 illustrates, a plurality of stabilizers 29 can be used in either embodiment to space the deflector tube 28 from the wash pipe.

The difference between the first embodiment and the second embodiment is that the second embodiment uses a downhole motor and downhole pump instead of eductor nozzles 34 to draw fluid upwardly through the tool. A drive sub 11 is connected to the workstring, and a motor housing section 13 of wash pipe is threaded to the lower end of the drive sub 11. A bearing housing section 15 of wash pipe is threaded to the lower end of the motor housing section 13. The motor housing section 13 houses a downhole motor 36, such as a mud motor, well known in the art. The downhole motor 36 drives a ported sub 38, which is housed in the bearing housing section 15. A bearing block 52 in the bearing housing section 15 supports the ported sub 38. The ported sub 38 drives a downhole pump 44, 46 in the ejection port section 12 of the wash pipe.

As the second embodiment of the tool 8' is rotated to mill away the metal item from the well bore with the milling tool 22, fluid is pumped by a pump (not shown) at the surface of the well site down through the workstring (not shown). The fluid flows from the workstring through the drive sub 11, and then through the downhole motor 36. Drive fluid exits the ported sub 38 via discharge ports 40, and exits the separator housing via drive fluid exit ports 42. Drive fluid supplied via the workstring flows upwardly through the annulus toward the surface of the well site, to return to the pump. An electric motor could be used instead of the mud motor, without departing from the spirit of the present invention.

The downhole motor 36 drives the downhole pump 44, 46 to draw bottomhole fluid into the inlet 48 of the downhole pump 44, 46. The bottomhole fluid is then discharged from a plurality of pump discharge ports 50, to exit the wash pipe ejection port section 12 via the ejection ports 24. A downhole motor driven by a fluid flow of 200 GPM can achieve a ported sub speed of 400 RPM. Turning the downhole pump at 400 rpm can easily produce a bottomhole recirculation rate of 1000 GPM. This high speed flow of bottomhole fluid is directed downwardly along the annulus surrounding the separator housing. An internal seal or packing 54 can be used to separate the drive fluid flow through the drive fluid exit ports 42 from the bottomhole fluid flow through the ejection ports 24.

As the downhole pump 44, 46 draws bottomhole fluid upwardly into the ejection port section 12 bottomhole fluid is drawn up through the intake ports 26 of the milling tool 22, through the deflector tube 28, and through the screen 32. The bottomhole fluid thusly drawn upwardly then passes out through the pump 44, 46 and the ejection ports 24 to the annulus surrounding the separator housing, to flow downwardly toward the milling tool 22.

As bottomhole fluid flows past the milling tool blades 23, it entrains small cuttings or debris generated as the blades mill away the casing or other metal item. This debris-laden fluid then enters the intake ports 26 at the lower end of the milling tool 22 and passes into the interior of the deflector tube 28 within the wash pipe extension section 18. As the debris-laden fluid exits the side ports 30 in the deflector tube 28, the debris, which is heavier than the fluid, tends to separate from the fluid and settle into an annular area 56 between the deflector tube 28 and the wash pipe extension section 18.

The fluid, which may still contain very fine debris, then flows upwardly to contact the inlet side of the screen 32. As the fluid flows through the screen 32, the fine debris is removed by the screen 32, remaining for the most part on the inlet side of the screen 32. Fluid leaving the outlet side of the screen 32 then flows upwardly to the inlet of the downhole pump.

One of the issues with the VACS system described in detail above was the ability of the mill to pass the debris into the tool. Standard junk mills 60 shown in FIG. 5 had a series of small ports 62 that connected with a central passage 64. While these mills were designed for flow to exit out the lower end ports 62 to take away milled debris around the outside of the body 60 making them run with the VACS tool required reversing the flow direction leading to clogging issues at the ports 62 before the debris would reach the still relatively narrow passage 64.

In an effort to improve the mill design for use with the VACS system where reverse flow was needed to get the cuttings into the tool, the mill of FIG. 6 was designed and disclosed in a patent application Ser. No. 12/029,228 filed Feb. 11, 2008 entitled Improved Downhole Debris Catcher and Associated Mill and commonly assigned with this application to Baker Hughes Incorporated. Here the mill of FIG. 5 was modified to the mill shown in FIG. 6 where the central passage 66 was the same size as 64 in FIG. 5 but the small inlets 62 were replaced with on large and offset inlet 68 that was about the same diameter as passage 66 to get around the problem of clogging the small inlets 62 in the former design in FIG. 5. It should also be noted that the style of the mills in FIGS. 5 and 6 was for milling debris in a situation where no recovery of a portion of the downhole tool being milled was to be recovered. Instead, the tool was to be fully milled up and the generated debris captured in the debris removal tool such as the VACS tool for example.

However, some applications demand a retrieval of the downhole tool after enough of it is milled up so that it is released from a fixed position downhole. Some packers, for example need to be milled until their slips release at which point they can be removed from the wellbore. The mills in FIGS. 5 and 6 are not suitable to support a retrieval tool ahead of the cutting structure. The mill body needs to be strong enough to support such a leading structure generally centered with the mill housing and at the same time the mill needs to have a passage structure with large passages so that if operated with reverse flow there is enough open area to prevent debris clogging at the cutting structure. These prior mills use heavy wall drill collars as the body so that the central passage is rather small for cuttings flow. It is therefore an object of the present invention to provide a mill that can mill up a downhole tool to release it and retain it for removal to the surface while at the same time providing a debris return passage system that will promote passage of debris to a debris removal tool which in the preferred embodiment is the VACS tool but can be another design that takes in debris at a lower end with reverse circulating flow. Ostensibly, the mill of the present invention can also have circulation rather than reverse circulation to remove debris to a debris removal tool by flowing the cuttings up an annulus around the outside of the mill; however, the benefit of the large internal passages is better utilized when the debris flows with reverse circulation to a debris removal tool above the mill. Those skilled in the art will be in a better position to understand the details of the invention from the description of the preferred embodiment and the associated drawings that appear below with the understanding that the full scope of the invention is given by the claim that appear below.

SUMMARY OF THE INVENTION

A mill is configured to have large debris passages disposed among a series of radially extending blades. The mill center is adapted to accept a retention nut that supports a tool that secures the downhole tool being milled out, such as a packer. Reverse flow takes cuttings into the large open area between the blades to pass up in an annular space around a support for the retention nut. The blades are welded to the support for the retention nut. The passage then opens up to a maximum dimension leaving only the tubular wall needed for structural strength to support the mill and conduct cuttings into a debris removal tool.

DETAILED DESCRIPTION OF THE PREFERRED EMBODIMENT

Figure 5:
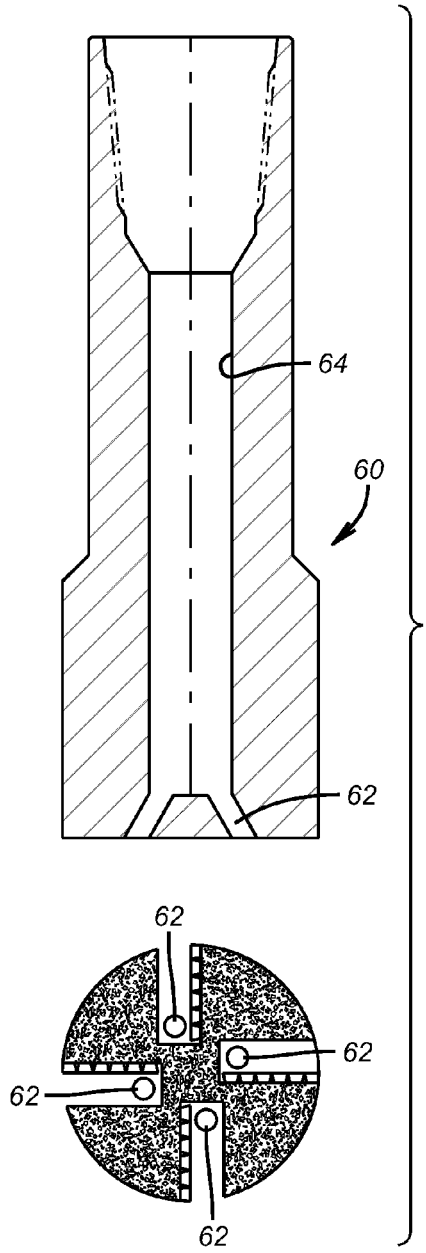
(PRIOR ART) FIG. 5
FIG. 5 is a mill that has been paired with the VACS tool shown in FIGS. 1-4 in the past.
Figure 7:
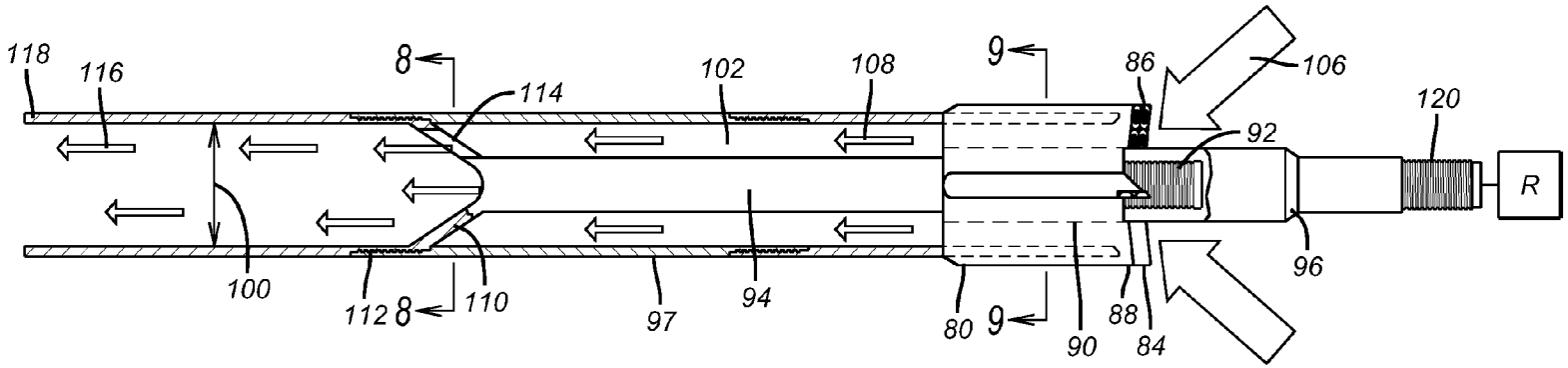
FIG. 7 is a section view of the present invention.
Figure 9:
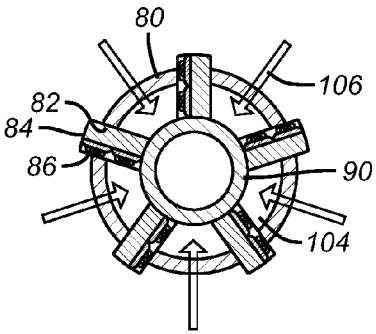
FIG. 9 is a view along line 9-9 of FIG. 7.
Figure 8:
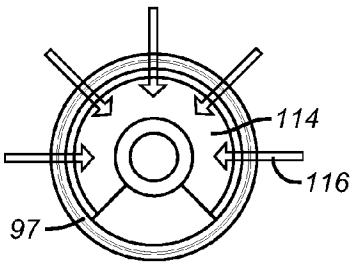
FIG. 8 is a view along line 8-8 of FIG. 7.
Figure 10:
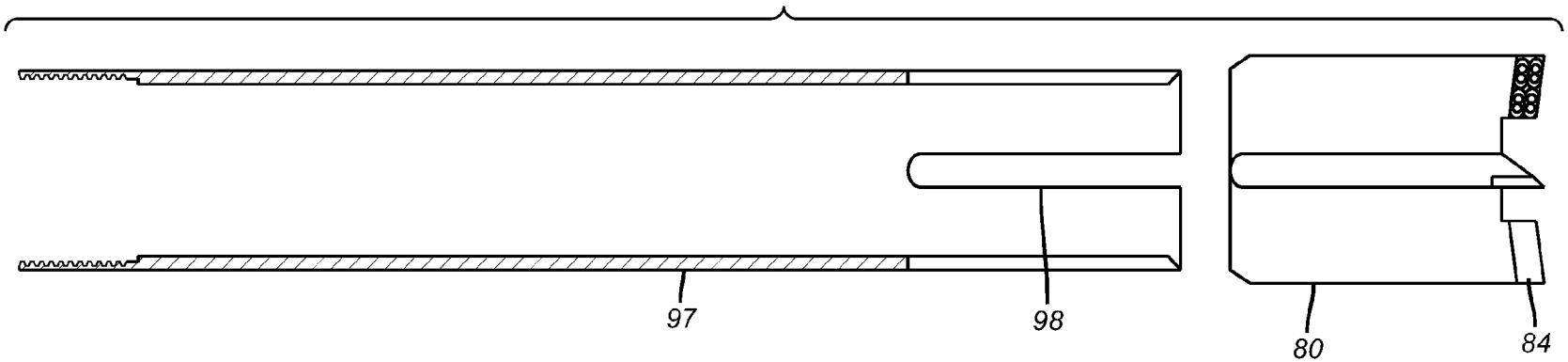
FIG. 10 is a view of the mill body and the tubular for conducting debris that is secured to it shown side by side.

Referring to FIGS. 7 and 9, a hollow mill body 80 has a plurality of slots 82 each of which receives a mill blade 84 that has a cutting structure 86 on a front face in the direction of rotation. Blades 84 extend axially beyond the lower end 88 of the body 80. Blades 84 are preferably welded to a central hub 90 that has a male thread 92 extending beyond the lower end 88 of the mill body 80. Welding blades 84 to the hub 90 rather than the mill body 80 keeps the heat of the mill body 80 and significantly reduces the chances for failure of the body 80 at the heat affected zone. A slotted bushing 94 threads into central hub 90 that is shown in dashed lines in FIG. 7. When the retention nut 96 is threaded to thread 92 it secures the bushing 94 to the body 80 and to itself without welding. Slotted tube 97 has slots 98 as shown in FIG. 10 with slots 98 slipping over a respective blade 84 on assembly into body 80 and further securing with preferably welding. Slotted tube 97 is made from fairly thin wall tubing as compared to the drill collars used for prior mills shown in FIG. 5. Whereas for a given range of tubular sizes to include all Baker Oil Tool Washpipe from 3.5 to 16 inches outside diameter the passage 64 would range from 1.5 to 12.75 inches inside diameter, the inside diameter represented by arrow 100 for the same tubular size range would be in the order of 3 to 15 inches or at least double the flow area of the drill collar based designs used in the past.

Figure 1:
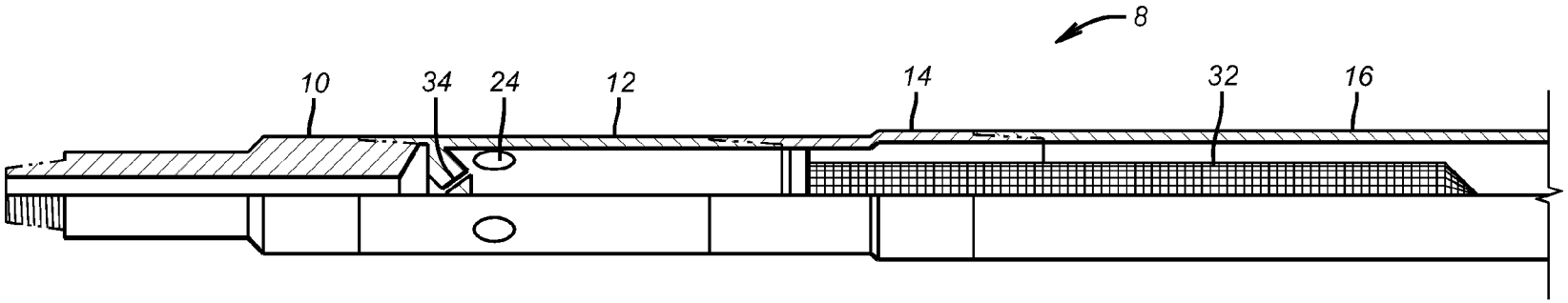
(PRIOR ART) FIG. 1
FIGS. 1-4 are two embodiments of a known debris removal tool sold by Baker Hughes Inc. and called a VACS tool.
Figure 2:
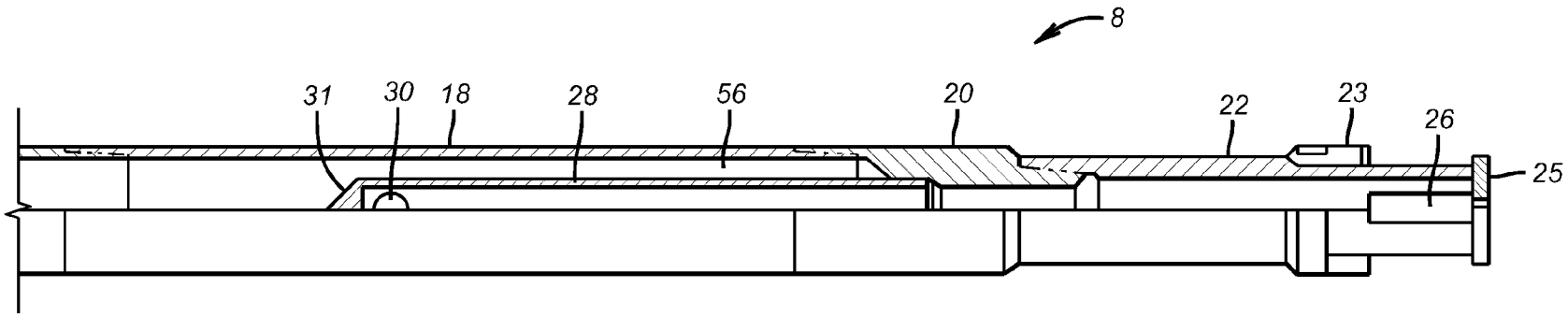
(PRIOR ART) FIG. 2
Figure 3:
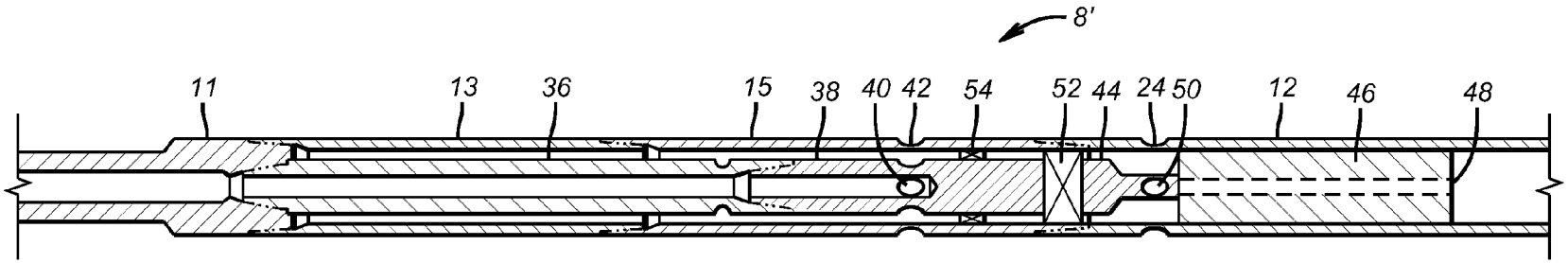
(PRIOR ART) FIG. 3
Figure 4:
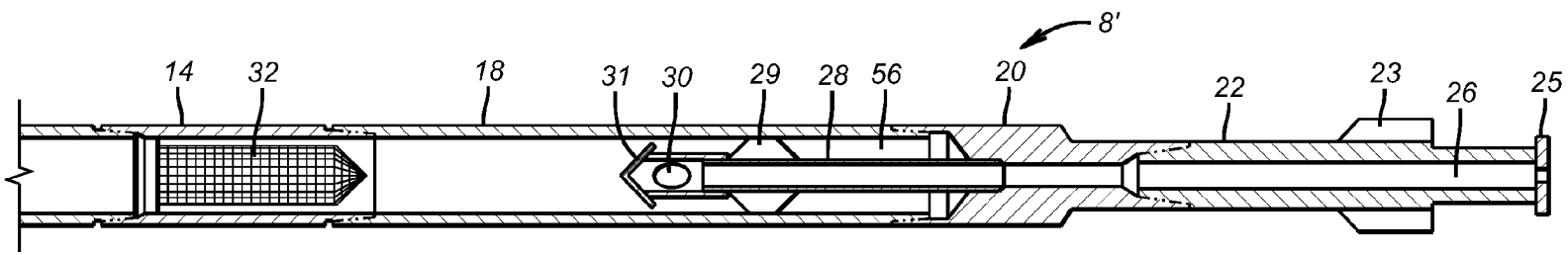
(PRIOR ART) FIG. 4
Figure 6:
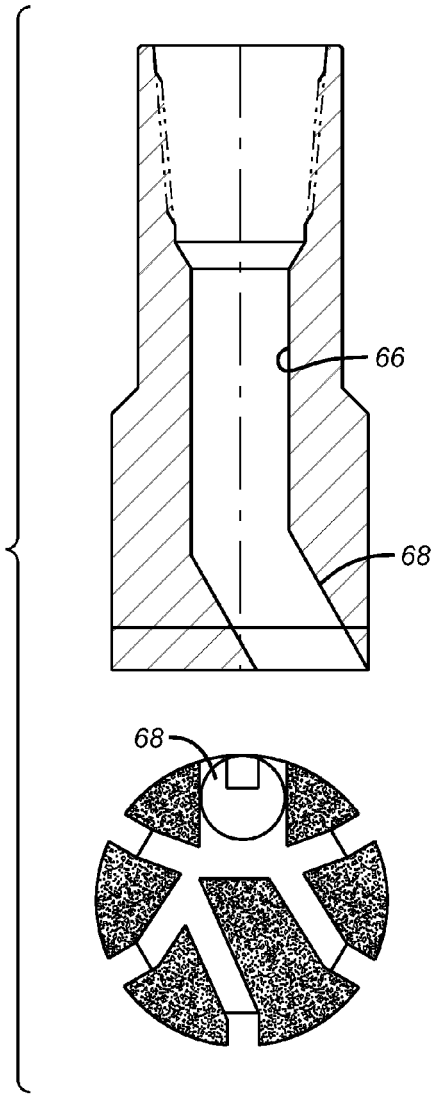
(PRIOR ART) FIG. 6
FIG. 6 is a recent improvement to the mill of FIG. 5 that is the subject of U.S. application Ser. No. 12/029,228 filed Feb. 11, 2008 and assigned to Baker Hughes Inc.

Bushing 94 defines an annular flow space 102 around itself and within tube 97. That annular space 102 is an extension of the inlets 104 between the blades 84 where debris laden flow indicated by arrows 106 enters the mill body 80 and flows to the annular space 102 as indicated by arrows 108. Nearer its upper end at 110 bushing 94 is threaded to tube 97 at thread 112. At location 110 there is a taper with about 270 degrees removed to create a large opening 114 where arrows 116 indicate further flow uphole into a debris removal tool such as the VACS illustrated in FIGS. 1-4. Those skilled in the art will appreciate that the mill 22 down to lower end 25 would not be present in FIG. 2 when fitting the assembly of FIG. 7 such that the upper end 118 of the bushing 94 can be secured directly or in close proximity to deflector tube 28 to thereby shorten the assembly as compared to the prior layouts while giving a significantly larger debris flow area into the debris removal tool.

Thread 120 supports a schematically illustrated and known retrieval tool R that can engage the object being milled such as a packer, for example, so that it can be engaged for removal when milled loose of its settling slips. It should be noted that in some offshore applications welded connections in a string that will support weight of the tool being milled out are not permitted by operators and in such instances the design of FIG. 7 would be used. In other applications where there are no such rules against welded connections, the central hub 90 can be welded to the body 80 and the bushing 94 can be eliminated. This makes for an even bigger debris passage starting right above the mill body 80. In that event the tube 97 would be welded to the body 80, as before, but would extend up to the upper end 118 for direct connection to the debris removal tool previously described or another such tool that takes a debris laden fluid stream in from its lower end.

Figure 11:
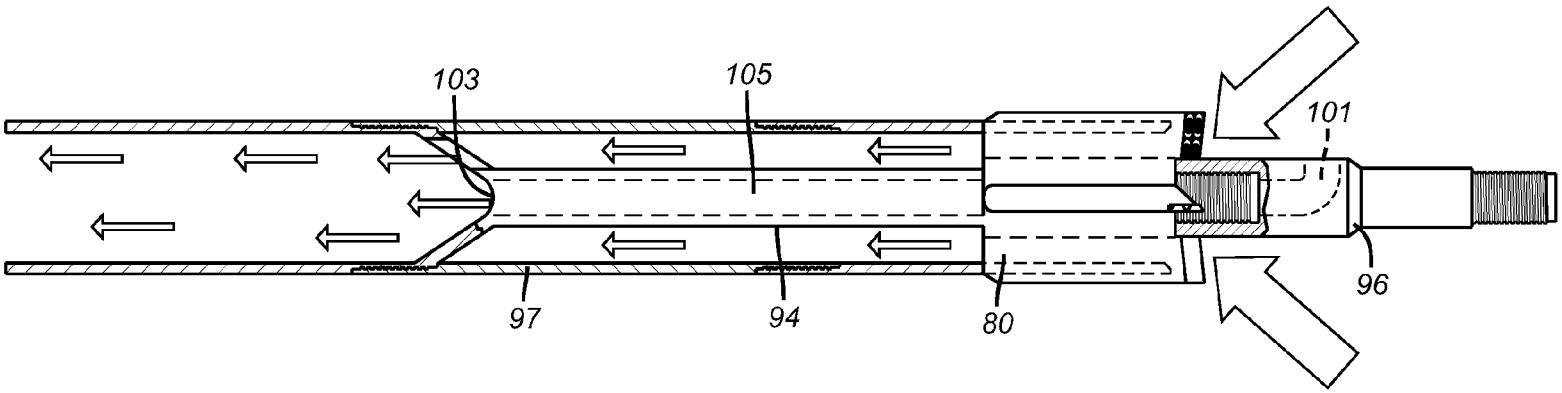
FIG. 11 shows an optional passage through the retrieval device.

As another alternative shown in FIG. 11, the nut 96 can be hollow with a lateral entrance 101 to take in milled debris and conduct it to an opening 103 in the bushing 94 through a passage 105 for additional flow area to be made available beyond annular space 102 by allowing debris flow up the interior of the bushing 94.

The present invention provides a reverse flow mill where reverse circulation takes the debris into the mill body and uphole toward the surface in combination with the ability to support a leading retrieval tool. Apart from that feature, the inlet flow with debris is around the annulus formed by the support for the retrieval tool and the mill body that is further created by the blades that span between the mill body 80 and the hub 90. Thus apart from the space taken by the blades 84 the rest of the annular space around the hub 90 is open for incoming flow of debris laden fluid. That annular space gets larger at 102 where the blades are no longer there. Optionally in some embodiments the open area can go to maximum dimension represented by arrow 100 right above the mill body 80 if the bushing 94 is not used. However, after the flow goes through opening 114 in the FIG. 7 version, the maximum flow area 100 is available. The upper end 118 can be connected directly to an inlet tube of a debris removal tool that works on the reverse circulation principle such as the VASC tool of Baker Hughes Inc. The above description is illustrative of the preferred embodiment and many modifications may be made by those skilled in the art without departing from the invention whose scope is to be determined from the literal and equivalent scope of the claims below.

I claim:

1. A milling assembly for subterranean use to mill and retrieve an object being milled, comprising:

a mill body having a lower end with a cutting structure thereon;

a retrieval assembly extending beyond said lower end for engaging the object for retrieval after it is milled loose;

at least one debris inlet in said lower end to remove debris from said cutting structure into said mill body with flow coming down outside said body and entering said inlet.

2. The assembly of claim 1, wherein:

said retrieval assembly defines an annular inlet into said mill body.

3. The assembly of claim 2, wherein:

said cutting structure comprises a plurality of radially extending blades extending across said annular inlet.

4. The assembly of claim 3, wherein:

said annular inlet at said lower end of said body is formed between pairs of blades that are circumferentially spaced about said retrieval assembly.

5. The assembly of claim 4, wherein:

the open area of said annular inlet increases above said blades.

6. The assembly of claim 5, wherein:

said body comprises a support tube connected to an upper end of said body which forms an annular passage around said retrieval assembly for debris coming into said annular inlet.

7. The assembly of claim 6, wherein:

said annular passage within said support tube becomes circular after passing through an opening in said retrieval assembly.

8. The assembly of claim 7, wherein:

said retrieval assembly extends beyond said support tube so that the flow path continues circular in said retrieval assembly.

9. The assembly of claim 8, wherein:

said retrieval assembly with said circular internal flow passage is connected to an inlet at a lower end of a debris removal device.

10. The assembly of claim 7, wherein:

the diameter of said circular configured flow path ranges from 3 to 15 inches for a tubular size of 3.5 to 16 inches outside diameter in the tubular portion of said retrieval assembly defining said circular flow passage therein.

11. The assembly of claim 3, wherein:

said blades are welded to a hub in said mill body through which said retrieval assembly is supported.

12. The assembly of claim 1, wherein:

said debris is directed from said debris inlet to a debris removal device.

13. The assembly of claim 12, wherein:

said debris removal device comprises at least one eductor to reduce pressure and induce debris laden flow into said inlet on said mill body.

14. The assembly of claim 1, wherein:

said mill body has a tubular extension into which said retrieval assembly extends to define an annular flow path that leads into a debris removal device.

15. The assembly of claim 14, wherein:

said retrieval assembly extends beyond said tubular extension in tubular form and has an opening into said annular flow path such that the flow path transitions into a circular shape between said opening and the debris removal device.

16. The assembly of claim 15, wherein:

said retrieval assembly is an elongated solid shape from said mill body to said opening where it transitions to said tubular shape.

17. The assembly of claim 15, wherein:

said retrieval assembly is an elongated hollow shape with an inlet below said mill body and an open top at said transition that comprises said opening.

* * * * *